United States Patent [19]

Durgan

[11] 4,022,453

[45] May 10, 1977

[54] CLAMP FOR ENGINE HEAD SERVICE TEST BENCH

[75] Inventor: Virgil R. C. Durgan, Tremont, Ill.

[73] Assignee: Caterpillar Tractor Co., Peoria, Ill.

[22] Filed: June 28, 1976

[21] Appl. No.: 700,243

[52] U.S. Cl. ..... 269/71; 29/217

[51] Int. Cl.[2] ..... B25B 1/24

[58] Field of Search ..... 269/17, 71, 81, 95, 269/249, 245, 45, 75; 29/215–217

[56] References Cited

UNITED STATES PATENTS

| | | | |
|---|---|---|---|
| 1,642,493 | 9/1927 | Esterline et al. | 29/217 |
| 1,670,253 | 5/1928 | Gilbert et al. | 269/45 |
| 2,991,669 | 7/1961 | Stock | 269/45 |
| 3,038,247 | 6/1962 | Clark | 29/215 |

*Primary Examiner*—Al Lawrence Smith
*Assistant Examiner*—Robert C. Watson
*Attorney, Agent, or Firm*—Wegner, Stellman, McCord, Wiles & Wood

[57] ABSTRACT

A service bench having an effectively universally adjustable clamp structure for servicing apparatus, such as engine valve assemblies, vehicle tires, track pins and bushings, and the like. The clamp is adjustably mounted in the service bench for movement alongside a service space defined thereby and includes clamping portions having adjustable spacing for effecting the desired clamping operation. At least one of the clamping portions is adjustable in a direction perpendicular to the clamping direction as by mounting thereof to an adjustably extensible portion of the clamp mounting element.

8 Claims, 2 Drawing Figures

26
29
30
25
10
16
28
14
46
36
35
11
27
31
32
33
34
12
13
37
38
39
41
40
42
44
23
24
22
21
45
43
20
17
18
19
53
47
50
51
52
48
15
49

CLAMP FOR ENGINE HEAD SERVICE TEST BENCH

BACKGROUND OF THE INVENTION

1. Field of the Invention

This invention relates to test, or service, benches and in particular to means for clamping apparatus and the like therein.

2. Description of the Prior Art

In a servicing of vehicle components, such as engines, track components, tires, etc., it is desirable to support the component to be serviced on a suitable service, or test, bench. One excellent example of such a servicing, or testing, bench is disclosed in copending application for U.S. Pat., application Ser. No. 595,649, of Virgil R. C. Durgan and Milton J. Palma, which application is owned by the assignee hereof. As disclosed therein, a universal mounting frame is rotatable on a longitudinal pivot axis carried by the support. Support rails are provided for carrying different elements of the servicing apparatus.

One conventional tool for servicing engine valves and springs utilizes C-shaped mounting element carrying on one arm a pneumatic cylinder. Another tool for servicing vehicle equipment, such as track, includes a C-shaped press frame having a hydraulic cylinder and rollover group.

In one conventional arrangement, the track tool apparatus is mounted on a cart.

Another conventional tool for servicing vehicle tires comprises a spotter and vulcanizer tool having a pair of articulated arms carrying suitable plates for engaging the tire wall.

SUMMARY OF THE INVENTION

The present invention comprehends an improved service and test bench structure having a clamp means which is effectively universally adjustable to facilitate servicing and testing of the apparatus.

The clamp means may be mounted on a C-shaped mounting element which is carried for movement alongside the service space in which the apparatus to be serviced is supported by the bench. The mounting means is selectively positionable alongside the service space, and in the illustrated embodiment, is provided with roller means for movably mounting the clamp means to an elongated rail extending alongside the service space.

The clamp means includes opposed clamping portions for clamping the apparatus therebetween. Means are provided for adjusting the relative spacing of the clamping portions in a clamping direction.

Further means are provided for selectively adjusting the relative positioning of the clamping portions in a direction transverse to the clamping direction. In the illustrated embodiment, this means comprises adjustably extensible means.

The adjustably extensible means may be locked in any one of a plurality of extended positions as desired.

The mounting element may be pivotally mounted to the roller means to provide low plate clearance for facilitated use of the service and test bench.

At least one of the clamping portions may comprise fluid-operated means, and in the illustrated embodiment, the upper clamping portion comprises pneumatic clamping means. In the illustrated embodiment, the lower clamping portion comprises mechanically adjustable clamping means.

The service and test bench structure of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figures 1, 2:
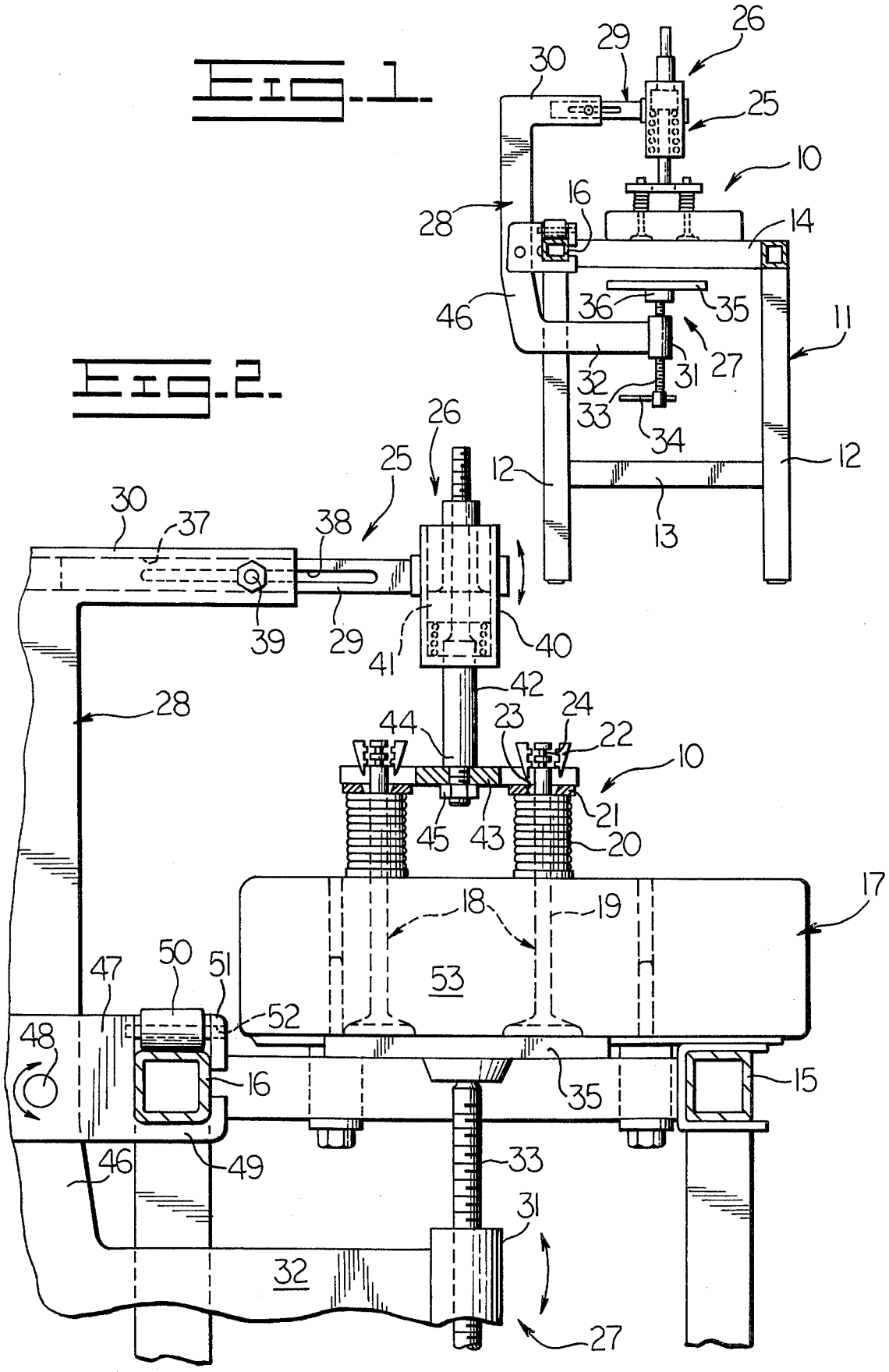
FIG. 1 is a side elevation of a service and test bench having improved clamping means embodying the invention.
FIG. 2 is a fragmentary enlarged side elevation illustrating in greater detail the improved service test bench structure.

In the exemplary embodiment of the invention as disclosed in the drawing, a service and test bench generally designated 10 includes a base 11 having a plurality of upright legs 12, lower cross pieces 13, upper cross pieces 14, a front rail 15, and a rear rail 16.

In illustrating the invention, the bench 10 is shown as used in testing an engine head 17 having a plurality of valves 18. Each valve includes a valve stem 19, the movement of which is controlled by a coil spring 20 compressed between the engine head 17 and a retainer 21, which, in turn, is retained on the upper end of the valve stem by conventional keepers 22 received in tapered recesses 23 of the retainers 21 and grooves 24 in the upper end of the valve stem 19.

To effect a clamping of portions of the apparatus to be serviced or tested, bench 10 further includes an improved adjustable clamp means generally designated 25. The clamp means include an upper clamp portion generally designated 26 and a lower clamp portion generally designated 27 carried on a C-shaped mounting element generally designated 28.

The upper clamp portion 26 is mounted to an adjustably extensible portion 29 of the upper leg 30 of the mounting element 28. The lower clamp portion 27 is mounted to a threaded end 31 of the lower leg 32 of the mounting element and includes a threaded shaft 33 provided with a distal handle 34 for manually adjusting the disposition of a backup plate 35 selectively mountable to the upper end 36 of the shaft.

Extensible portion 29 of the upper leg 30 of the C-shaped mounting element 28 is received in an elongated channel 37 in leg 30 and is provided with a longitudinal slot 38 for cooperation with a locking screw 39 for locking the extension 29 in any one of a plurality of different extended positions, as best seen in FIG. 2.

In the illustrated embodiment, the upper clamp means 26 may comprise a fluid-operated clamp means, and more specifically, may comprise a pneumatic clamp means having a pneumatic cylinder portion 40 provided with a piston 41 having an outwardly extending piston rod 42 carrying, at its lower end, any one of a plurality of different pressure plates, such as pressure plate 43, as best seen in FIG. 2. The pressure plates may be adapted for use with the specific arrangement of the apparatus being serviced, and in the illustrated embodiment, pressure plate 43 is adapted for the specific arrangement of valves 18 of the engine 17. As shown in FIG. 2, the pressure plates may be removably installed on the distal end 44 of the piston rod 42 by suitable threaded means, such as nut 45.

The C-shaped mounting element further defines a bight portion 46. A carrier bracket 47 is pivotally mounted to the bight portion 46 by a pivot pin 48 and is provided with a lower end portion 49 underlying the rear rail 16. A plurality of rollers 50 are rotatably mounted to the bracket 47 by a retainer plate 51 and roller shaft 52 to roll along the upper surface of the rail 16 in the longitudinal direction of the rail. Thus, the bracket 47 is mounted on the rail for movement longitudinally thereof and the C-shaped mounting element 28 is pivotally mounted to the bracket for swinging about the axis of pin 48 extending parallel to the longitudinal axis of the rail. Such swinging action of the mounting element provides facilitated installation and removal of the apparatus being serviced or tested as by facilitated positioning of the pressure plate 43 relative to the service space generally designated 53 between the rails 15 and 16, as seen in FIG. 2.

The extensible positioning of mounting element portion 29 permits the pneumatic ram 40 to be adjusted positionally in a direction transverse to the clamping direction between the pressure plates 43 and 35 for improved facilitated servicing and testing.

In using the bench structure of the present invention, the piston rod 42 is retracted so as to provide maximum accessibility to the service space 53. The mounting element 28 may be suitably positioned longitudinally on rail 16 and a desired pressure plate 43 secured to the piston rod 42. The backup plate 35 is brought upwardly by adjustment of shaft 33 to engage the workpiece. In the illustrated embodiment, the backup plate 35 is brought into engagement with the valves 18.

Clamp portion 40 is then operated to engage the pressure plate 43 with the spring retainers 21 to compress the springs 20 sufficiently to permit removal of the keepers 22 whereupon the valve assembly components may be removed from the engine 17.

The reassembly of the valve components is effected by a reverse procedure with the pressure plate 43 maintaining the springs 20 compressed to permit the facilitated insertion of the keepers 22.

The improved mounting of the pressure plate provides an effective universal adjustability affording facilitated simplified servicing and testing of apparatus in the bench 10. The bench is adapted for facilitated interchangeability of different plates and the like by the facilitated selective mounting thereof on the clamping portions 26 and 27. As indicated above, the improved clamping means is advantageously adapted for use with the test apparatus of copending application Serial No. 595,649 for providing further improved facilitated servicing and testing therewith.

The foregoing disclosure of specific embodiments is illustrative of the broad inventive concepts comprehended by the invention.

I claim:

1. In a service and test bench having a support rail for supporting apparatus to be serviced in a service space adjacent said rail, and adjustable clamp means having opposed clamping portions for clamping therebetween the apparatus to be serviced, the improvement comprising: mounting means movably carried on said support rail; a C-shaped carrier having a bight and opposed legs; pivot means pivotally mounting said carrier bight to said mounting means adjacent said rail, one of said carrier legs carrying one of said clamping portions and the other of said carrier legs being provided with extensible connecting means for carrying the other of said clamping portions for relatively positioning the clamping portions in a direction perpendicular to the clamping direction, movement of said mounting means on said rail causing selective positioning of said clamp means with said clamping portions at any one of a plurality of opposed portions of said service space; means for adjusting the spacing of said one clamping portion from the other clamping portion in a clamping direction; and means for selectively adjusting the extensible connecting means to adjacent the positioning of said one clamping portion relative to the other clamping portion in a direction transverse to said clamping direction.

2. The service bench structure of claim 1 wherein said carrier is pivotally mounted for swinging of said clamps about the longitudinal extent of said support rail.

3. The service bench structure of claim 1 wherein said C-shaped member includes an upper leg overlying said service space, one of said clamping portions being carried on said upper leg and the other of said clamping portions being carried on said lower leg.

4. The service bench structure of claim 1 wherein said C-shaped member includes an upper leg overlying said service space and a lower leg underlying said service space, one of said clamping portions being carried on said upper leg and the other of said clamping portions being carried on said lower leg, and said pivot means comprises means for pivotally mounting said bight portion for pivoting about a substantially horizontal axis.

5. The service bench structure of claim 1 wherein at least one of said clamping portions is fluid operated.

6. The service bench structure of claim 1 wherein said mounting means comprises roller means riding on said rail.

7. The service bench structure of claim 3 wherein said extensible connecting means comprises an extension of at least one leg of said C-shaped member and locking means for locking the extension in any one of a plurality of different extended positions on said arm.

8. The service bench structure of claim 1 wherein at least one of said clamping portions comprises a fluid operated ram.

* * * * *